US009944081B2

(12) United States Patent
Till

(10) Patent No.: US 9,944,081 B2
(45) Date of Patent: Apr. 17, 2018

(54) CLEANING ADAPTER AND METHOD FOR CLEANING PRINT HEADS

(71) Applicant: TILL GMBH, Kelkheim (Taunus) (DE)

(72) Inventor: Volker Till, Hofheim am Taunus (DE)

(73) Assignee: TILL GMBH, Kelkheim (Taunus) (DE)

( * ) Notice: Subject to any disclaimer, the term of this patent is extended or adjusted under 35 U.S.C. 154(b) by 0 days.

(21) Appl. No.: 14/917,280

(22) PCT Filed: Sep. 12, 2014

(86) PCT No.: PCT/EP2014/069536
§ 371 (c)(1),
(2) Date: Mar. 8, 2016

(87) PCT Pub. No.: WO2015/036559
PCT Pub. Date: Mar. 19, 2015

(65) Prior Publication Data

US 2016/0214386 A1 Jul. 28, 2016

(30) Foreign Application Priority Data

Sep. 13, 2013 (DE) ..... 10 2013 110 122

(51) Int. Cl.
*B41J 2/165* (2006.01)
*B41J 3/407* (2006.01)

(52) U.S. Cl.
CPC ..... *B41J 2/16505* (2013.01); *B41J 2/16517* (2013.01); *B41J 2/16535* (2013.01);
(Continued)

(58) Field of Classification Search
CPC ..... B41J 2/16505; B41J 2/16517; B41J 2/16535; B41J 2/16547; B41J 2/16552; B41J 3/4073
See application file for complete search history.

(56) References Cited

U.S. PATENT DOCUMENTS 5,239,316 A 8/1993 Demarchi et al.
5,572,245 A 11/1996 Cowger
(Continued)

FOREIGN PATENT DOCUMENTS

DE 4035507 A1 6/1991
DE 102006052154 A1 5/2008
(Continued)

*Primary Examiner* — Jason Uhlenhake
(74) *Attorney, Agent, or Firm* — Leydig, Voit & Mayer, Ltd.

(57) ABSTRACT

A cleaning adapter cleans print heads in an installation for the printing of containers. The installation includes a printing machine having an inkjet print head and a transport system that moves the containers to be printed. The container is moved past the print head and, in so doing, is printed with liquid printing inks. The cleaning adapter is designed in such a way that it is introducible into the transport system in place of one of the containers to be printed and is moveable to the print head for cleaning purposes. The cleaning adapter comprises a container which is hollow in portions and has an opening. The cleaning adapter, in regions thereof in which the transport system acts thereon during transport, has an external form corresponding to the containers to be printed, so that the cleaning adapter is configured to be positioned utilizing the transport system.

12 Claims, 5 Drawing Sheets

(52) U.S. Cl.
CPC ..... *B41J 2/16547* (2013.01); *B41J 2/16552* (2013.01); *B41J 3/4073* (2013.01)

(56) References Cited

U.S. PATENT DOCUMENTS

| | | | | |
|---|---|---|---|---|
| 6,182,566 | B1 | 2/2001 | Kubatzki et al. | |
| 2003/0218654 | A1 | 11/2003 | Wouters | |
| 2008/0042321 | A1 | 2/2008 | Russell et al. | |
| 2011/0232514 | A1 | 9/2011 | Putzer et al. | |
| 2011/0285768 | A1 | 11/2011 | Preckel | |
| 2012/0255450 | A1 | 10/2012 | Till | |
| 2015/0062240 | A1* | 3/2015 | Kraus | B41J 2/16552 347/25 |

FOREIGN PATENT DOCUMENTS

| | | | |
|---|---|---|---|
| DE | 102009058219 | A1 | 6/2011 |
| WO | WO 2010130397 | A1 | 11/2010 |

* cited by examiner

CLEANING ADAPTER AND METHOD FOR CLEANING PRINT HEADS

CROSS-REFERENCE TO PRIOR APPLICATIONS

This application is a U.S. National Stage Application under 35 U.S.C. § 371 of International Application No. PCT/EP2014/069536 filed on Sep. 12, 2014, and claims benefit to German Patent Application No. DE 10 2013 110 122.4 filed on Sep. 13, 2013. The International Application was published in German on Mar. 19, 2015 as WO 2015/036559 A1 under PCT Article 21(2).

FIELD

The present invention relates to a cleaning device in the form of a cleaning adapter for cleaning print heads, in particular inkjet print heads, in an installation for the printing of three-dimensional containers, such as in particular bottles made of plastics material or glass, wherein the containers to be printed are moved in the installation by a transport system to a printing machine with the at least one print head and a region to be printed on the container is positioned in front of the print head. Further, the invention relates to a corresponding cleaning method and to an installation set up for carrying out the cleaning method.

BACKGROUND

Installations for the printing of containers are used above all in the industrial sector. An installation of this type is described by way of example in DE 10 2009 058 219 A1. This installation, for the printing of containers, has a plurality of printing machines connected in series which are formed as a carousel, through which machines the containers to be printed are passed via a transport system constructed from various systems, such as chucking device, transport devices and holding means. The containers are moved in each carousel past the print heads of the printing machines and thus are provided with a printed pattern before being transferred into the subsequent carousel. After passing through the installation, the containers are provided with the desired motif. Of course, installations with only one printing machine, in particular one in the form of a carousel printing machine, are also known, and the invention equally relates to these.

When these installations are used on an industrial level, above all a high throughput rate is a factor relevant to competition. By way of example at this point we mention an installation for processing bottles in which up to 36,000 bottles per hour are passed through the installation. Within the installation, the bottles are guided past print heads of the printing machine and in so doing are printed with liquid printing inks via the inkjet print heads.

Printing machines for inkjet printers within such installations as a rule operate with one or more print heads having a plurality of nozzles. In this case, approximately 1000 of said nozzles are arranged in a row on the print head in order to obtain the desired resolution in the region to be printed. Since especially in industrial use a high throughput rate with high and permanent print quality is required, efficient maintenance and cleaning of the print heads is also necessary. Experience shows that the print heads become soiled due to the continuous operation required by the type of application. Thus for example dust and ink deposits may soil the nozzles. These problems are intensified when using UV-curing inks if the printed container after printing is irradiated with UV light while still in the printing machine to fix the printed-on ink. Scattered UV light can also cure the ink which is still in the nozzles and make the print head unusable if it is not cleaned regularly and effectively.

In order to maintain the functionality and print quality of the print heads, a print head therefore has to be cleaned at certain intervals. Several cleaning methods which are known in principle are available for this purpose. A first possible way is to wipe off the soiling from the print head by means of a stripper or the like in the manner of mechanical cleaning. A system which operates in such a manner is described for example in US 2003/0218654 A1. Here, a print head, for the purpose of cleaning, is moved from its operating region into a maintenance region in which a cleaning device of a wiper unit with a type of windscreen wiper moves along the underside of the print head with the nozzles, so that residues of the printing liquid are removed by the stripper or wiper. After cleaning, the print head is moved back into its operating region.

What is problematic here, however, is that the cleaning system involves an increased space requirement. Furthermore, the cleaning operation is complex owing to the moving of the print head, because a corresponding adjustment means is provided which in addition has to ensure very reliable and precise repositioning so that the print quality is not adversely affected. In addition, moving the print head into the cleaning position has an adverse effect on the throughput of the entire installation, because the print head cannot be used for a considerable period of time within the installation.

One further known possibility for cleaning a print head consists of flushing the print head through. Cleaning and flushing solutions may be used here. Also all the nozzles can be controlled, optionally even multiply, so that those nozzles which are seldom used are also flushed through. In this case, flushing may also take place with the ink actually used for printing. In both cases, it is however necessary to collect the emerging liquid and dispose of it specifically. However, in particular if the nozzles are flushed through under pressure, the immediate surroundings of the print head, for example other print heads, may also be soiled by ink, or splashes of cleaning agent or the like which are contaminated with ink. Also an ink mist may occur which is deposited at unwanted points.

DE 10 2006 052 154 A1 describes a cleaning device for the cleaning of inkjet printers in which the print head is cleaned as described previously. The ink ejected from the inkjet print head during the cleaning operation is collected in a collecting container. For this, the print head to be cleaned is moved out of its operating position into a maintenance and cleaning position. Then the print head is flushed for a certain time by means of excess pressure in the ink system, so that ink flows out of all the nozzles at the same time and dust or dirt particles, and also cured ink residues, are flushed away. A lamella arrangement on the collecting device collects the dirt and guides it into the collecting container.

Here too, the problem linked to the disadvantages already described exists, namely that the print head cannot be used for a comparatively long period of time and has to be moved out of its operating position into a cleaning position.

A printer device and a method for printing on a print medium with a print head and a transport device for the print medium are known from U.S. Pat. No. 6,182,566 B1. Therein, the print head is not moved during printing, but the print medium is moved relative to the print head by a transport means and a displacement means. For cleaning, the print head is pivoted about an axis into a predetermined position to a cleaning and sealing station.

A printing apparatus for the printing of bottles or similar containers is known from US 2011/232514 A1. This has a plurality of printing positions on a transport element which can be driven in rotation, with which the printing position and the containers are moved on a closed path of movement from a container charge station to a container removal station. In order to avoid soiling of the print heads, a protective sleeve is provided which surrounds the container to be printed during printing. During printing, when the protective sleeve is closed an air stream is generated through the protective sleeve, and atomised printing ink is removed by extraction tubes.

SUMMARY

In an embodiment, the present invention provides a cleaning adapter for cleaning print heads in an installation for the printing of three-dimensional containers. The installation includes a printing machine, which has at least one print head formed as an inkjet print head, and a transport system configured to move the containers to be printed to the at least one print head for printing purposes whereby a region to be printed on the container is positioned in front of the inkjet print head. The installation is configured such that the container is moved past the inkjet print head and, in so doing, is printed with liquid printing inks via the inkjet print head. The cleaning adapter is configured so that the cleaning adapter is introducible into the transport system in place of one of the containers to be printed and, for cleaning purposes, is moveable by the transport system to the inkjet print head so as to be positioned in front of the inkjet print head. The cleaning adapter comprises a container which is hollow at least in portions and which has at least one opening. The cleaning adapter, in regions of the cleaning adapter in which the transport system acts on the cleaning adapter during transport, has an external form which corresponds to the containers to be printed, so that the cleaning adapter is configured to be positioned utilising the transport system for the containers to be printed.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
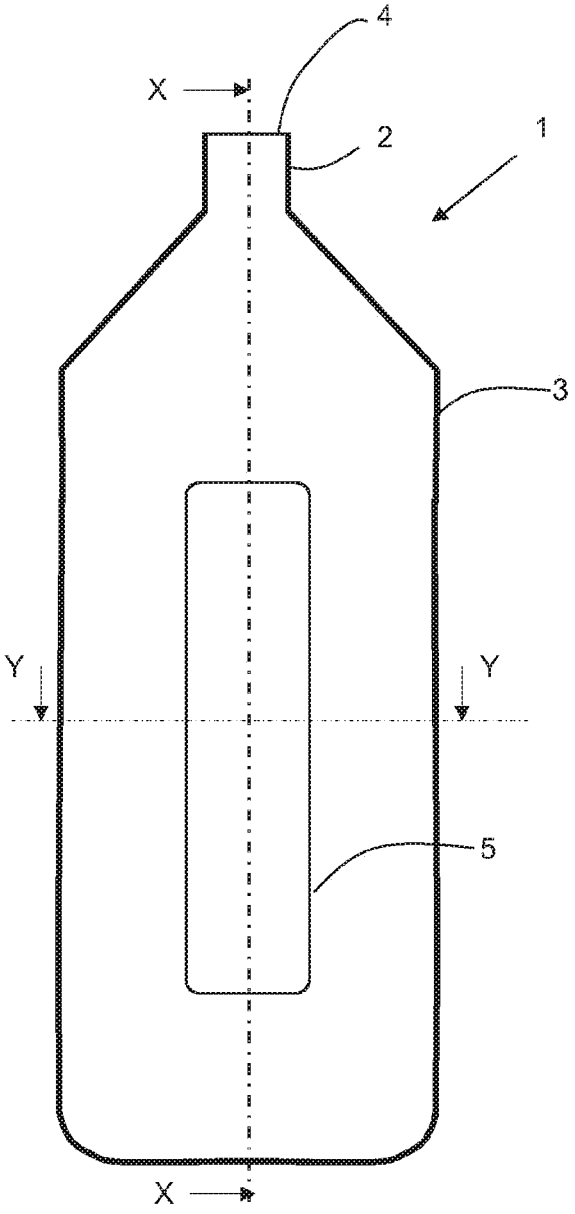
FIG. 1 is a side view of a cleaning adapter according to the invention according to a first embodiment.

In an embodiment, the present invention provides a way of carrying out the cleaning of print heads which takes only a small amount of time and of constructing the printing and maintenance means in as simple a manner as possible.

In the case of the cleaning device according to an embodiment of the invention in the form of a cleaning adapter, it is proposed that the cleaning adapter, which has in particular means for cleaning the print head, in particular means suitable for mechanical cleaning and/or flushing-through of the nozzles of the print head, is designed such that the cleaning adapter can be introduced into the transport system of the installation in place of a or the container to be printed and for cleaning purposes can be moved by the transport system to the print head and can be positioned in front of it. In this case, the means for cleaning the print head are arranged on the cleaning adapter such that they are positioned by the transport system in front of the print head if the cleaning adapter introduced into the transport system in place of the container to be printed is in a position in which a container to be printed can be printed, i.e. is printed in normal operation (and not in the cleaning operation). According to the invention, the cleaning adapter can therefore be positioned in a position in front of the print head in which a container to be printed is printed.

In printing installations or printing machines, as a rule containers, such as bottles, are printed in large numbers, the print heads of the printing machines printing a certain region on the bottle surface. The cleaning adapter can then be placed directly in the row of bottles or containers which are to be printed and enters into the installation or passes through the installation in place of a container to be printed. The means for cleaning are matched to the printing process in terms of their position on the cleaning adapter and can be arranged on the adapter in particular in terms of their vertical position such that they are at the same level as the region to be printed on the bottle.

Using angle encoding of a container rotary drive in the transport system, the cleaning adapter can also be positioned in a simple manner in front of the print head for example by turning a turntable such that the means for cleaning are positioned directly in front of the print head and the nozzles thereof which are to be cleaned. As a result, the cleaning operation can be started immediately in regular operation without the print head having to be moved out of the printing position into a cleaning position.

The configuration according to an embodiment of the invention of a cleaning device, i.e. of the cleaning adapter, therefore offers the possibility of using the transport system to position the cleaning adapter in front of the print head in the same manner as the container to be printed, the cleaning adapter simulating the presence of the three-dimensional container in the printing system of the installation. Instead of being printed, the cleaning adapter however cleans the print head, for which purpose the print head and/or the cleaning adapter can optionally be suitably controlled.

In the prior art, the existing cleaning devices are not adapted to the printing system or the installation such that they would be able to be moved via the transport system to the print head. Rather, the print head is moved to the cleaning system. The solution according to an embodiment of the invention in contrast offers the possibility of cleaning the print head without having to move it into a cleaning position, which proves time-saving, is less expensive in terms of plant and ensures accurate positioning of the print head in the printing machine (also referred to as printing system or printing installation), because the print head is not moved. The positioning of the cleaning adapter can take place according to the invention using the existing transport system for the containers to be printed. For this, the cleaning adapter according to an embodiment of the invention preferably has an external form which corresponds to the container to be printed, in particular in those regions of the cleaning adapter or the container in which the transport system acts on the cleaning adapter or container during transport.

As means for cleaning the print head, the cleaning adapter may simply have wiping elements for wiping off the print heads and/or openings for receiving cleaning agent or ink which is sprayed out of the nozzles of the print head.

As has already been discussed in detail, a corresponding cleaning method is provided according to another embodiment of the invention for the use of the proposed cleaning adapter for inkjet print heads in a corresponding installation for the printing of containers provides, in order to carry out the cleaning operation, for at least one of the described cleaning adapters according to an embodiment of the invention to be introduced into the transport system and for cleaning purposes to be moved by the transport system to the print head. The print head is then cleaned by the cleaning adapter in the appropriate manner, in particular as is still to be described in detail.

A cleaning adapter which according to an embodiment of the invention is particularly advantageous can be formed by a container which is hollow at least in portions and which has at least one opening which can act in particular as a means for cleaning the print head.

A cleaning adapter of this type is suitable above all for cleaning the nozzles of a print head by means of excess pressure. The cleaning adapter may for example be a special cleaning bottle. It is introduced into the machine or placed into the transport system of the installation, and is aligned directly in front of the rows of print nozzles of a print head. In this case, the opening or openings of the cleaning adapter, which is in bottle form, which are distributed across the periphery, is/are positioned directly in front of the nozzles of the print head. The cleaning adapter, which will also be referred to in the embodiment below as "bottle", provides a receiving container for cleaning solution, flushing solution or ink which is flushed out of the nozzles, preferably under pressure. Depending on the number of openings which are distributed over the periphery of the container, the adapter may serve as a common collecting container for a plurality of, for example for two or more, print heads which are arranged for example around the bottle in the printing machine and thus can be cleaned at the same time.

Within the cleaning adapter, a division or subdivision in particular in the sense of a partition may be provided, which prevents liquid or particles ejected from the nozzles of the print head from being distributed in the surroundings of the print head and being deposited for example on other print heads. It is for example possible for the interior of the container of the cleaning adapter to be subdivided into segments, each opening preferably being associated with its (otherwise closed) own segment within the cleaning adapter. The subdivision above all offers the possibility of cleaning a plurality of print heads at the same time without the nozzle jet of a print head soiling another print head. In the case of a bottle which substantially has a round shape, these segments may for example be formed by walls which extend from the outer periphery in the direction of the centre of the bottle and thus form walls which are oriented obliquely to the opening. In this manner, a rebound effect of the liquid injected into the opening can also be prevented, because the liquid which is flushed out under pressure and strikes the wall is thus laterally deflected if it strikes the walls. Re-emergence of ink mist or cleaning-agent mist from the bottle is in this manner effectively prevented or at least minimised.

In a development of the inventive concept underlying this cleaning possibility, provision may also be made that for cleaning purposes ink and/or cleaning or flushing solution be ejected from the nozzles of the print head. For cleaning purposes, all the nozzles may be flushed through several times.

The liquid ejected from the nozzles can be collected in the cleaning adapter in a basin or reservoir which according to the invention is formed on the bottom of the cleaning adapter, and preferably adjoins the opening, for example in the form of a bottle bottom. Then the bottle or the cleaning adapter is moved out of the printing machine or for example the entire installation again via the transport system. It is thus ensured that cleaning without soiling of the installation can automatically be carried out.

In this context, it has proved particularly advantageous if for cleaning the print heads with a cleaning or flushing solution first of all the ink supply is disconnected from the print head by means of a valve system. Said head is connected via the valve with an infeed and return line to a flushing-solution supply means. In this manner, many types of cleaning can be combined effectively.

To inject the ink residues and the other soiling into the cleaning adapter aligned in front of the print head, first of all ink can be ejected into the cleaning bottle. Then it is possible to switch to cleaning by means of flushing solution or cleaning solution, which is likewise collected in the adapter. To conclude the cleaning, it is possible to switch back to ink again. The cleaning liquid which is still located in the print head is expelled by the ink which is reconnected, and is collected in the container. Both cleaning and flushing solution and the ink residues or soiling are collected within the bottle. Once the cleaning has been concluded, the cleaning adapter is guided out of the installation by the transport system. The print head is already available again for printing purposes when the cleaning adapter has left its printing position and is being transported in the transport system.

A further embodiment of a cleaning adapter according to an embodiment of the invention provides for it to have at least one wiping element for cleaning the print head. In this case too it proves advantageous that the cleaning adapter is moved via the transport system to the print head and the wiping element is positioned in front of the print head. There, the wiping element can come into direct contact with the print head and dab or wipe off the residues of the printing process, or wipe away soiling.

In a development of this inventive concept, it is possible for the wiping element to be designed to take up ink. It may in particular be an absorbent element, such as a sponge, which binds the ink by soaking it up and removes excess residue from the print head. Also cloths, preferably lint-free cloths, or other means suitable for these purposes, such as cleaning cloths, are suitable according to the invention.

Particularly efficient cleaning can be achieved if the wiping element is moved up to the print head and then is moved relative to the print head, so that soiling is mechanically removed, i.e. wiped off. By moving the wiping element to the print head for cleaning purposes, damage to the print head for example during the transport of the cleaning adapter is also avoided.

In an embodiment of the invention, provision may be made for the cleaning adapter, for moving the wiping element to the print head, to have a displacement means (movement means) which can preferably be activated by pressurising the cleaning adapter from the inside. Air pressure or a pressure generated by a similar medium or fluid, for example from a hydraulic system, is suitable for this.

The displacement means is preferably formed by a membrane arranged behind the wiping element, which membrane covers the opening in sealing manner and moves the wiping element up to the print head or presses it thereagainst if the cleaning adapter is pressurised from the inside and the membrane is forced out through the opening. This is possible in that the otherwise closed cleaning adapter is acted upon for example via a container mouth (normal bottle opening) with a pressurised medium, such as compressed air. The membrane then expands in the direction of its openings and pushes the wiping element up to the print head. Since the distance between the container and print head is only a few millimetres, the wiping element comes to lie against the surface of the print head.

In particular in conjunction with the displacement means discussed above, it proves advantageous if the cleaning adapter after being pressurised is additionally moved or displaced relative to the print head such that it also mechanically cleans the nozzles. This is possible for example by means of a lifting system, with which for example bottles in an installation are moved into the print head arrangement or printing machine. The wiping element on the cleaning bottle in this case wipes off the surfaces of the print heads and collects mechanical soiling. By reducing the internal bottle pressure again, the membrane retreats and the bottle can be moved out of the installation.

According to an embodiment of the invention, it is preferable to soak up emerging ink or cleaning liquid from the print head surface by means of a suction nozzle. Using the drive elements for a lifting movement of the cleaning adapter, the suction nozzle preferably integrated in the cleaning adapter can be moved vertically along the print head and take up excess liquid in an ideal case even in contact-free manner. The negative pressure can be generated by a battery-operated pump which is arranged in a separate vacuum chamber to which the suction nozzle is connected.

Furthermore, provision may be made for the printing operation to be monitored via a separate camera system, or one integrated in the installation, which is connected to a software module, the software module being able to be set up such that it monitors the quality of the printed image and decides whether a cleaning operation has to be carried out. Preferably the software module is set up such that a decision is taken using the printed image as to which of the cleaning methods according to the invention is used. If there is a smeared ink ring in the printed image, mechanical cleaning may be necessary in order to remove a dust particle. If a colour is missing, this may indicate a clogged nozzle, so it is recommended to flush the nozzle by ejecting ink and/or cleaning liquid under pressure.

The software module may further be set up such that automatic loading of the corresponding printing machine is prevented if it is recognised that cleaning is necessary.

It proves particularly advantageous if the software module is set up to decide whether immediate cleaning is to be carried out, because this involves a smaller loss of production than postponing cleaning until a planned production stoppage and continuing to operate the entire installation until then with a reduced number of printing stations or machines.

In a further embodiment, the present invention provides an installation for the printing of three-dimensional containers, such as bottles made of plastics material or glass, wherein the containers to be printed in the installation are guided or can be guided by a transport system for printing purposes to at least one print head. The installation is set up such that the cleaning of the at least one print head is carried out according to the previously described method according to the invention or parts thereof using a cleaning adapter according to an embodiment of the invention.

The cleaning adapter proposed according to an embodiment of the invention and the cleaning method based on the use of this adapter prove particularly cost-efficient in particular in installations with a plurality of print heads per printing machine and/or a plurality of printing machines with one or more print head(s) in each case. A plurality of arrangements of print heads can be cleaned in succession by a cleaning adapter in that the adapter can be placed into the transport system of the installation, where it in each case cleans one or more print head(s) and is moved to the next printing station or printing machine once the cleaning operation has been concluded.

FIG. 1 shows a cleaning adapter 1 in the form of a bottle, as is conventionally suitable for holding liquids. The bottle 1 has a bottle body 3 which extends to a bottle neck 2, the body tapering conically in the transition to the bottle neck 2. The bottle neck 2 has an upper opening 4 in the manner of a regular bottle. The cleaning adapter 1 illustrated is used in particular in installations for the printing of bottles, and therefore simulates the product to be printed with regard to its shape. Such installations have in particular a plurality of printing machines or printing stations with one or more print heads in each case.

Figure 2:
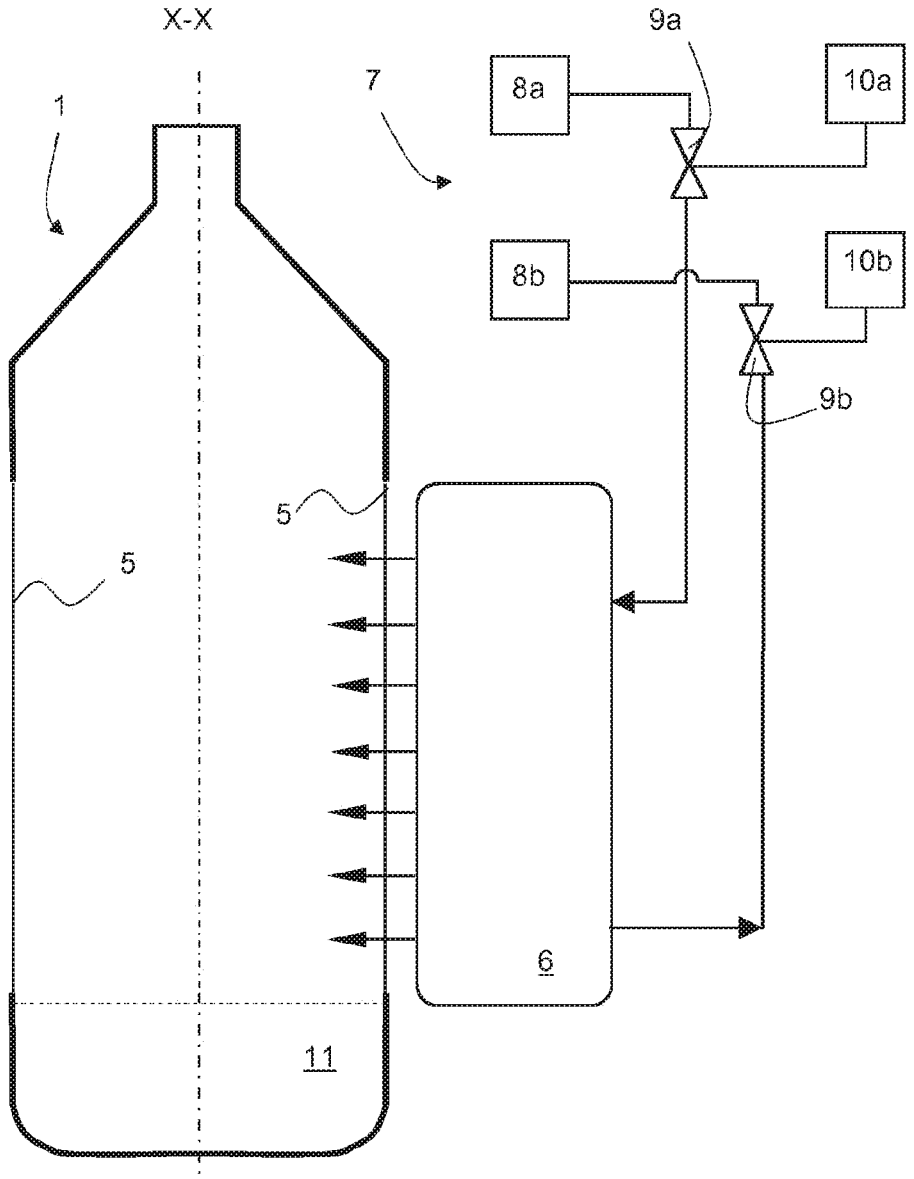
FIG. 2 is a sectional view of the cleaning adapter of FIG. 1 with a print head to be cleaned.

In the main region of the bottle body 3, an opening 5 is visible which is located in that region of the surface which is to be printed in the case of a normal bottle. Through the opening 5, liquids which are ejected from a print head 6 (illustrated in FIG. 2) can pass into the interior of the bottle 1 and be collected there. As can be seen from FIG. 1, the opening 5 does not extend as far as the bottom of the bottle 1. Between the bottom of the bottle 1 and the opening 5, a reservoir 11 for collecting liquids is thus formed.

In order to carry out the operation of cleaning the print head 6, the cleaning bottle (cleaning adapter 1) is inserted into a transport system of the installation and is moved or transported as far as the print head 6. By means of the transport system, the bottle 1 is aligned positioned directly in front of the print head. In so doing, the bottle 1 is rotated by means of a rotary drive so that the opening 5 is aligned with the print head 6, i.e. is positioned directly in front of the print head 6, as illustrated in the sectional view X-X in FIG. 2.

The bottle 1, illustrated here rotated by 90° compared with FIG. 1, is positioned with its opening 5 directly in front of the or a print head 6. The opening 5 is somewhat larger in terms of its dimensions (width, height) than the arrangement consisting of the nozzles (indicated only by the arrows starting from the surface of the print head 6) on the print head 6, out of which nozzles the ink is sprayed onto the surface of a normal bottle during printing.

A printing-liquid supply system 7 is connected to the print head 6, via which system the ink is supplied to the print heads. Ink passes into the print head 6 via an ink infeed 8*a*, while excess ink can correspondingly leave the print head 6 via an ink return feed 8*b*. For cleaning purposes, ink is pumped out of the ink infeed into the print head 6 and sprayed via the nozzles under pressure through the opening 5 into the bottle 1. Additionally, the print head 6 prior to this can be moved even closer to the bottle 1, as long as provision is made for this for example even in a normal printing operation. The print head 6 preferably assumes the same position as during the printing operation.

For cleaning the print head 6, a valve system 9*a*, 9*b* can additionally be provided with which the ink supply can be disconnected from the print head 6 and the print head 6 can be connected to an infeed line 10*a* and a return line 10*b* for a cleaning agent, for example a cleaning liquid. For this, the valves 9*a*, 9*b* can be switched accordingly.

For cleaning purposes, the ink supply system 7 is thus disconnected from the print head via the valves 9*a*, 9*b*. The cleaning liquid passes via the infeed into the print head 6 and flushes particles of dirt and ink residues, preferably also under pressure, into the bottle 1. In order to remove the cleaning liquid from the print head again and to prepare the latter for printing again, the valves 9*a*, 9*b* are switched over again and the printing-liquid supply system 7 is connected to the print head 6. At the same time, the cleaning-agent system 10*a*, 10*b* is disconnected from the print head 6. By switching over to ink, the cleaning liquid is then expelled from the print head 6 by the ink which is reconnected, and is conveyed into the bottle 1. The print head 6 is now available for printing purposes again.

The liquids (ink, cleaning liquid) sprayed into the bottle 1 collect below the opening 5 in the reservoir 11. Once the cleaning operation has been concluded, the bottle 1 can be transported on to the next print head 6, this being cleaned corresponding to the method described previously. Once the cleaning operation for all the print heads 6 to be cleaned has been concluded, the bottle 1 can be removed from the installation along the transport system, it being possible to dispose of the liquid collected therein simply outside the installation. After cleaning, the cleaning adapter 1 can also be reused.

Figure 3:
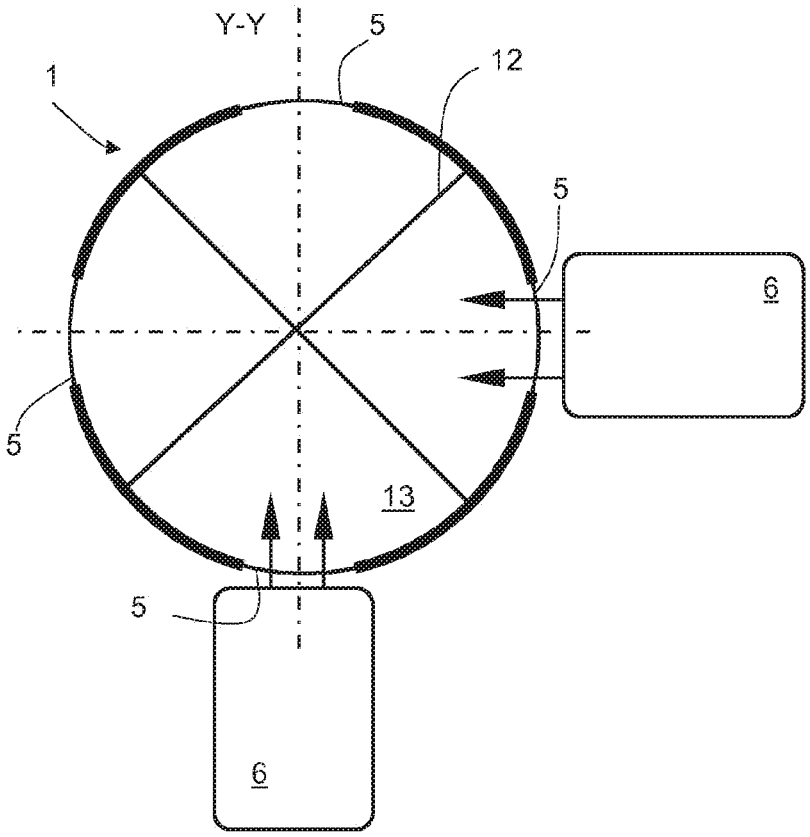
FIG. 3 is a plan view in section through a development of the cleaning adapter of FIG. 1.

A development of the cleaning adapter 1 illustrated in FIG. 1 is shown in FIG. 3. Therein, the cleaning adapter 1, which is designed as a bottle, is shown in a plan view along the line Y-Y of FIG. 1. This bottle 1 however differs from the bottle 1 illustrated in FIG. 1 in that it has additional openings 5 and an internal subdivision 12. A total of four openings 5 are uniformly distributed over the periphery of the bottle 1.

Two print heads 6, which are oriented here towards the bottle 1 at an angle of 90 degrees and for example print various colours, are also illustrated. The subdivision 12 within the bottle 1 is constructed of intersecting walls which prevent liquid which is sprayed out of the nozzles of a print head 6 into an opening 5 from emerging from the other openings 5 again and thus resulting in soiling.

At the same time, the walls, which are oriented obliquely to the openings 5, prevent splashback and rebounding ink mist of the injected liquid. The subdivision or division 12 causes segment-like chambers 13 to be formed for each of the openings 5. The walls of the subdivision 12 of each segmented chamber 13 in this case are oriented obliquely to the opening 5, so that liquid which is sprayed out of the print head 6 into the segmented chamber 13 cannot pass back directly to the opening 6. In this manner, injected liquid is effectively prevented from spraying back through the opening 5 to the outside and a resulting ink mist is prevented from soiling the surrounding area and the print head 6 again.

Figure 4:
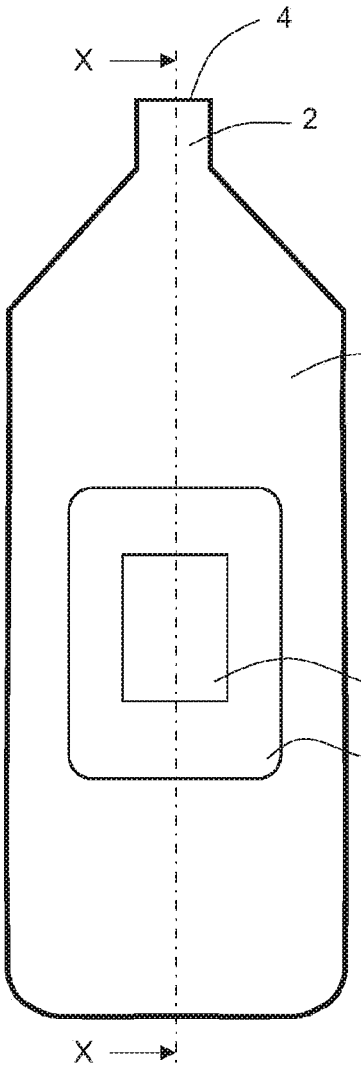
FIG. 4 is a side view of a cleaning adapter according to the invention according to a further embodiment.
Figure 5:
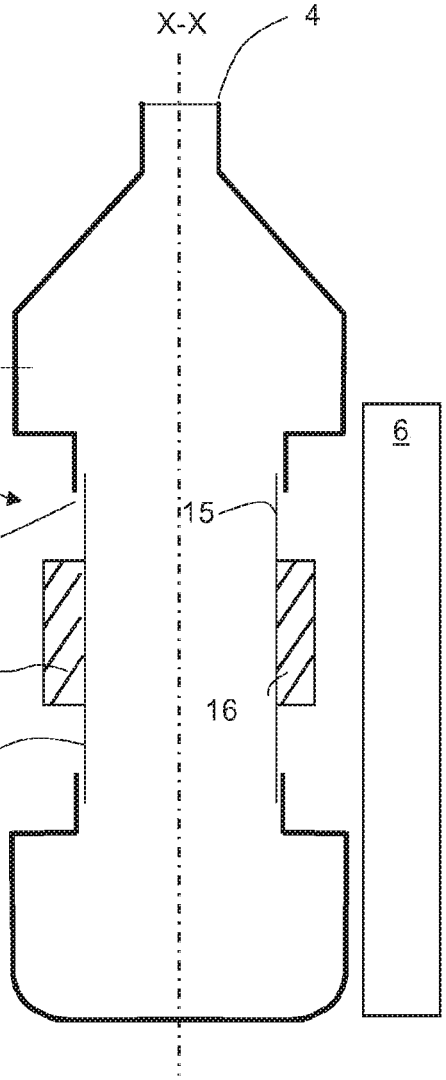
FIG. 5 is the cleaning adapter of FIG. 4 in a sectional view which is rotated relative to FIG. 4 with a print head to be cleaned.

A further variant of the cleaning adapter in the form of a bottle 1 is illustrated in FIGS. 4 and 5. FIG. 4 shows a side view of the cleaning adapter 1, and FIG. 5 shows it in a sectional view along the line X-X of FIG. 4. The bottle 1 has a central bottle body 3 and also a bottle neck 2, the bottle body 3 tapering conically towards the bottle neck 2. An upper opening 4 is provided at the outer end of the bottle neck 2, as is generally conventional with bottles.

In the region of the bottle body 3 there is a region 14 with two opposing openings 5 which is set back towards the interior of the bottle 1. In the region of each opening 5 there is arranged a membrane 15 which covers and closes off the opening 5. On the outside of the membrane 15 there is arranged a wiping element 16 in the form of a sponge. In FIG. 5, the bottle 1 is oriented towards a print head 6 which is to be cleaned.

Figure 6:
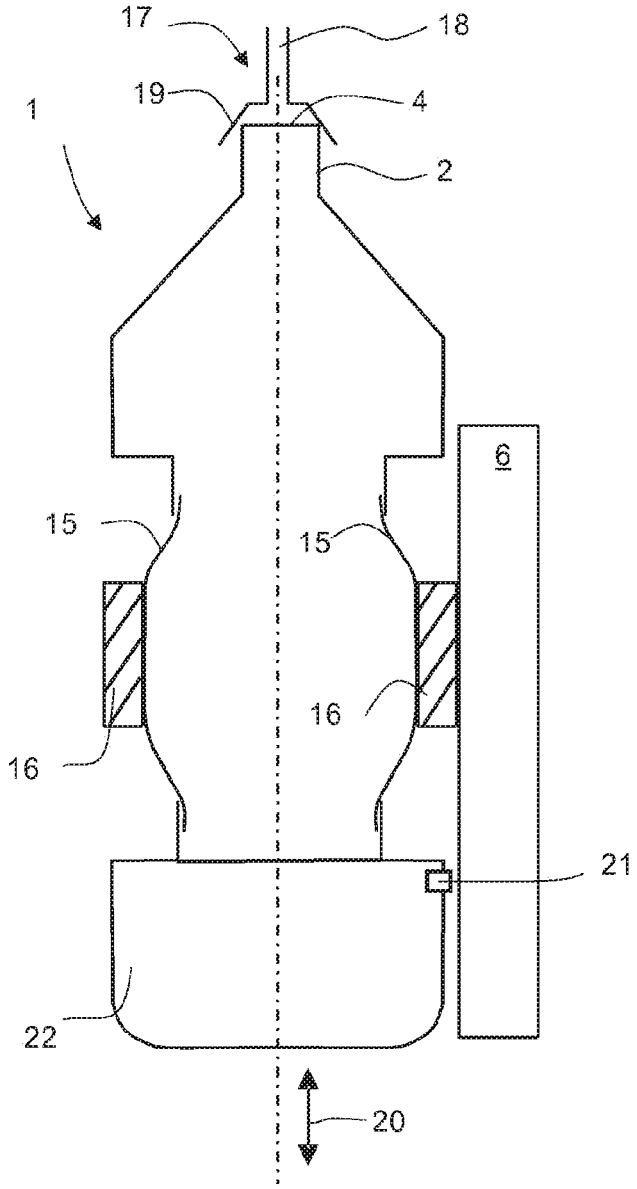
FIG. 6 shows the cleaning adapter of FIGS. 5 and 6 during the cleaning operation.

Air pressure is guided through the upper opening 4 via the bottle neck 2 and into the bottle 1 using a compressed-air supply means 17. The pressure-medium supply means 17 has a line 18 for conveying the compressed air and has at its end facing the bottle 1 a centring means 19 which tapers conically in the direction of the line 18, by means of which means the line 18 and the bottle 1 are centred relative to one another as illustrated in FIG. 6, and which ensures a firm, sealing connection of the compressed-air supply means to the bottle 1.

If compressed air is then forced into the bottle 1 via the compressed-air line 18, the pressure in the bottle 1 rises. The membranes 15 expand outwards as a result of the increased internal pressure. They act as a displacement means 15 and guide the sponge 16 fixed thereto directly to the print head 6. The sponge 16 comes to lie against the surface of the print head 6 and can absorb ink and dirt residues.

The double arrow indicates an additional lifting movement 20 with which the cleaning of the print head 6 can be improved. If the bottle 1 is moved up and down by means of a lifting system relative to the print head 6 corresponding to the lifting movement 20, the sponge 16 wipes along the surface of the print head 6. In so doing, it collects all the soiling mechanically and by means of its suction action additionally also absorbs ink residues etc. which are still present.

Once the cleaning has been concluded, the air pressure can be reduced again via the compressed-air supply means 18, as a result of which pressure on the membranes 15 is relieved and the wiping element 16 moves in the direction of the interior of the bottle again.

In the bottle 1 according to FIG. 6, which serves as a cleaning adapter, a suction nozzle 21 is further provided which is arranged separated from the overpressure system previously described in a vacuum chamber 22 and is aligned or can be aligned with a suction opening in the direction of the print head 6. Due to a negative pressure generated in the vacuum chamber 22, the suction nozzle 21 draws up ink or cleaning liquid emerging from the print head 6, the suction nozzle 21 also being able to be moved up and down relative to the print head 6, corresponding to the lifting movement 20.

In order to maintain a negative pressure supply which is self-sufficient in the bottle 1, a pump driven by a battery or rechargeable battery is provided in the vacuum chamber 22, which pump is capable of generating a negative pressure suitable for the extraction in the comparatively small volume of the vacuum chamber, which is closed off from the rest of the bottle 1.

Even if here the embodiment according to FIG. 6 illustrates an overpressure system and a negative pressure system in a bottle 1, the invention also relates to cleaning adapters 1, in particular in bottle form, in which only an overpressure system or only a negative pressure system as described above individually in each case is realised.

Thereafter, the bottle 1 can be transported further and removed from the installation.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 cleaning adapter, bottle
2 bottle neck
3 bottle body
4 upper opening
5 opening
6 print head
7 printing-liquid supply system
8*a* ink infeed
8*b* ink return feed
9*a*, 9*b* valve
10*a* cleaning-agent infeed
10*b* cleaning-agent return feed
11 reservoir
12 subdivision
13 segmented chamber
14 set-back region
15 displacement means, membrane
16 wiping element, sponge
17 compressed-air supply means
18 compressed-air line
19 centring means
20 lifting movement
21 suction nozzle
22 vacuum chamber

The invention claimed is:

1. A cleaning adapter for cleaning print heads in an installation for the printing of three-dimensional containers, the installation including a printing machine, which has at least one print head formed as an inkjet print head, and a transport system configured to move the containers to be printed to the at least one print head for printing purposes whereby a region to be printed on the container is positioned in front of the inkjet print head, the installation being configured such that the container is moved past the inkjet print head and, in so doing, is printed with liquid printing inks via the inkjet print head, the cleaning adapter being configured so that the cleaning adapter is introducible into the transport system in place of one of the containers to be printed and, for cleaning purposes, is moveable by the transport system to the inkjet print head so as to be positioned in front of the inkjet print head, wherein the cleaning adapter comprises a container which is hollow at least in portions and which has at least one opening, the cleaning adapter, in regions of the cleaning adapter in which the transport system acts on the cleaning adapter during transport, having an external form which corresponds to the containers to be printed, so that the cleaning adapter is configured to be positioned utilising the transport system for the containers to be printed, and wherein the cleaning adapter has a same shape as the container to be printed at least at top and bottom regions of the cleaning adapter.

2. The cleaning adapter according to claim 1, wherein an interior of the container of the cleaning adapter is subdivided into segments.

3. The cleaning adapter according to claim 2, wherein each of the segments is associated with an opening.

4. The cleaning adapter according to claim 1, wherein the cleaning adapter has at least one wiping element configured to clean the inkjet print head.

5. The cleaning adapter according to claim 1, further comprising one or more suction nozzles configured to draw off excess liquid from a surface of the inkjet print head.

6. The cleaning adapter according to claim 1, wherein, outside of the at least one opening, the cleaning adapter has an external form which corresponds to the container to be printed.

7. The cleaning adapter according to claim 1, wherein the cleaning adapter has a shape which simulates the container to be printed.

8. A method for cleaning print heads in an installation for the printing of three-dimensional containers, the installation including a printing machine, which has at least one print head formed as an inkjet print head, and a transport system configured to move the containers to be printed to the at least one print head for printing purposes whereby a region to be printed on the container is positioned in front of the inkjet print head, the installation being configured such that the container is moved past the inkjet print head and, in so doing, is printed with liquid printing inks via the inkjet print head, the method comprising:

providing a cleaning adapter designed in such a way that the cleaning adapter is introducible into the transport system in place of one of the containers to be printed and, for cleaning purposes, is moveable by the transport system to the inkjet print head so as to be positioned in front of the inkjet print head, wherein the cleaning adapter comprises a container which is hollow at least in portions and which has at least one opening, the cleaning adapter, in regions of the cleaning adapter in which the transport system acts on the cleaning adapter during transport, having an external form which corresponds to the containers to be printed, and wherein the cleaning adapter has a same shape as the container to be printed at least at top and bottom regions of the cleaning adapter;

introducing the cleaning adapter into the transport system; and moving, by the transport system for cleaning purposes, the cleaning adapter to the inkjet print head so as to be positioned in front of the inkjet print head.

9. The method according to claim 8, further comprising, for cleaning purposes, ejecting at least one of ink, cleaning solution or flushing solution from a nozzle of the inkjet print head.

10. The method according to claim 8, wherein, for cleaning purposes, the cleaning adapter is pressurized from an inside.

11. The method according to claim 8, wherein the cleaning adapter, which has at least one wiping element for cleaning the inkjet print head, is displaced relative to the inkjet print head such that the inkjet print head is mechanically cleaned by wiping off.

12. An installation for the printing of three-dimensional containers, the installation comprising:

a printing machine having at least one print head formed as an inkjet print head;

a transport system configured to guide the containers to be printed to the at least one print head for printing purposes whereby a region to be printed on the container is positioned in front of the inkjet print head, the installation being configured such that the container is moved past the inkjet print head and, in so doing, is printed with liquid printing inks via the inkjet print head; and a cleaning adapter designed in such a way that the cleaning adapter is introducible into the transport system in place of one of the containers to be printed and, for cleaning purposes, is moveable by the transport system to the inkjet print head so as to be positioned in front of the inkjet print head, wherein the cleaning adapter comprises a container which is hollow at least in portions and which has at least one opening, the cleaning adapter, in regions of the cleaning adapter in which the transport system acts on the cleaning adapter during transport, having an external form which corresponds to the containers to be printed, and wherein the cleaning adapter has a same shape as the container to be printed at least at top and bottom regions of the cleaning adapter, wherein the installation is configured to clean the inkjet print head by introducing the cleaning adapter into the transport system and moving, for cleaning purposes, the cleaning adapter to the inkjet print head so as to be positioned in front of the inkjet print head.

* * * * *